United States Patent [19]

Parrott et al.

[11] 4,155,598

[45] May 22, 1979

[54] LONGWALL MINING MACHINE

[75] Inventors: George A. Parrott, Wakefield; Paul Greenhough, Cleckheaton, both of England

[73] Assignee: Dresser Europe S.A., Brussels, Belgium

[21] Appl. No.: 859,395

[22] Filed: Dec. 12, 1977

[30] Foreign Application Priority Data

Dec. 23, 1976 [GB] United Kingdom ..... 53874/76
Nov. 21, 1977 [GB] United Kingdom ..... 53874/77

[51] Int. Cl.[2] ..... E21C 35/20

[52] U.S. Cl. ..... 299/43; 299/53; 299/86; 241/189 R

[58] Field of Search ..... 299/32, 34, 43–53, 299/85, 86, 87; 173/29; 74/384; 241/27, 189 R

[56] References Cited

U.S. PATENT DOCUMENTS

| | | | |
|---|---|---|---|
| 3,191,452 | 6/1965 | Lipski et al. | 74/384 |
| 3,857,520 | 12/1974 | Ducasse | 241/189 R |
| 3,907,367 | 9/1975 | Nakajima | 299/53 |
| 3,945,680 | 3/1976 | Henrich et al. | 299/43 |

FOREIGN PATENT DOCUMENTS

| | | |
|---|---|---|
| 1137618 | 4/1963 | Fed. Rep. of Germany. |
| 1984410 | 4/1968 | Fed. Rep. of Germany. |
| 1657629 | 10/1973 | Fed. Rep. of Germany. |

*Primary Examiner*—Ernest R. Purser
*Assistant Examiner*—Nick A. Nichols, Jr.
*Attorney, Agent, or Firm*—Larson, Taylor and Hinds

[57] ABSTRACT

A longwall mining machine incorporates breaking apparatus comprising an underframe which may be an integral extension of the main underframe of the machine and which is mounted on the conveyor for movement therealong, such that the breaking apparatus is rigidly secured to, and comprises an integral part of, the mining machine. The breaking apparatus also comprises a rotary breaking element drivably carried by the breaker underframe and a reaction plate, for example, on the same underframe, which is spaced from an adjacent periphery of the breaking element. In use, material, such as coal and rocks, on the conveyor passing between the rotary element and the reaction plate is broken against the reaction plate by the rotating breaking element. In this way, the coal and rocks are broken down to a sufficiently small size that they will not become jammed under the main underframe of the mining machine.

8 Claims, 5 Drawing Figures

LONGWALL MINING MACHINE

Figure 1A:
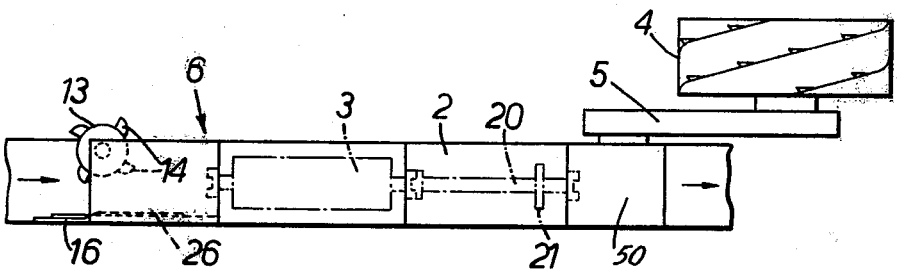

This invention relates to a longwall mining machine for use on a face conveyor.

In U.S. patent application Ser. No. 807305, filed June 16, 1977, and now U.S. Pat. No. 4,123,110, there is disclosed an auxiliary device adapted to be connected to a conveyor mounted, longwall mining machine, the auxiliary device comprising an underframe adapted for mounting on and movement along the conveyor of the mining machine, and a rotary breaking element, drivably carried by the underframe, the latter being provided with reaction means, for example in the form of a plate, against which material may be impacted and which is spaced from an adjacent periphery of the rotary element, the arrangement of the rotary element and the reaction means being such that, in use, material on the conveyor passing between the rotary element and the reaction means is broken against the reaction means by the rotary element as the latter rotates. In this way the possibility of large lumps of coal or rock becoming jammed under the frame of the mining machine, straddling the conveyor, is obviated.

As will of course be appreciated the auxiliary device is a separate unit from the mining machine. It is now proposed, in accordance with the present improvement of the earlier invention, to incorporate the breaking(or crushing)device in the mining machine so as to simplify the overall construction.

According to the present invention there is provided a longwall mining machine for use on a face conveyor, the mining machine incorporating breaking apparatus comprising an underframe adapted for mounting on and movement along the conveyor, and a rotary breaking element drivably carried by the underframe, the letter being provided with reaction means against which material may be impacted and which is spaced from an adjacent periphery of the rotary element, the arrangement of the rotary element and the reaction means being such that, in use, material on the conveyor passing between the rotary element and the reaction means is broken against the reaction means by the rotary element as the latter rotates.

The reaction means may be in the form of a reaction plate and may be provided with longitudinally extending ribs facing towards the adjacent periphery of the rotary element.

The mining machine may incorporate a single motor unit operative to drive the rotary element as well as the haulage unit and rotary face working element of the mining machine.

The breaking apparatus may include a transmission unit comprising an input drive draft coupled to be driven by the said motor unit and an output, driven shaft to which the rotary element is coaxially and directly coupled. Conveniently, the rotary element is mounted with its axis of rotation vertical, the upper end of the rotary element being the driven end and the lower end of the rotary element being supported by a bearing in the underframe of the breaking apparatus. The output shaft of the transmission unit may be coupled to the rotary element by a connector at one end of the shaft and a further connector can be provided on the other end of the shaft, so that the transmission unit could have been installed at a corresponding position nearer the other end of the machine by turning the transmission unit over so that the second-mentioned connector is lowermost, and then connecting the rotary element to this latter connector.

The underframe in one construction is an integral extension of the main underframe of the mining maching.

The rotary element may be adjustably mounted on the underframe and means provided for adjusting the spacing of the rotary element from the reaction means.

Figure 1B:
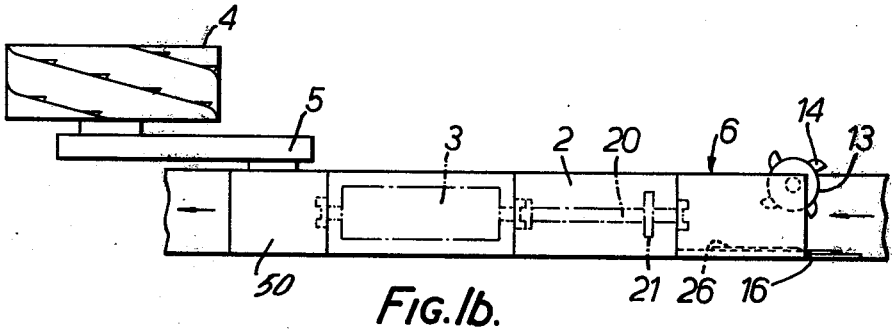
Figure 2:
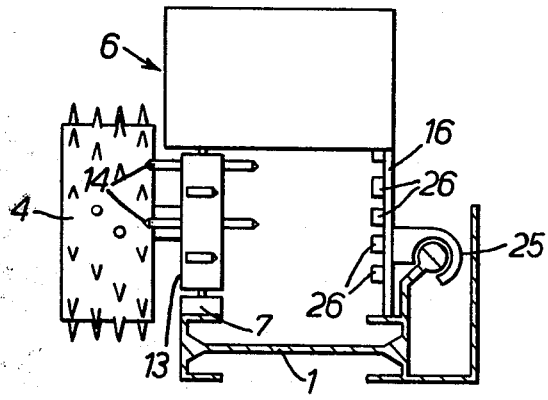
Figure 3:
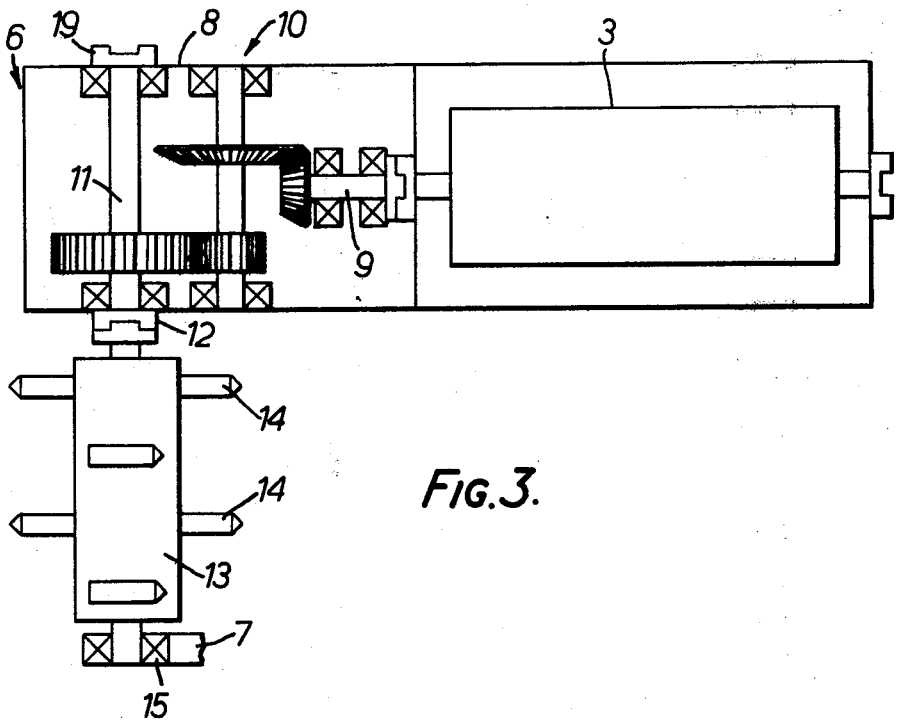
Figure 4:
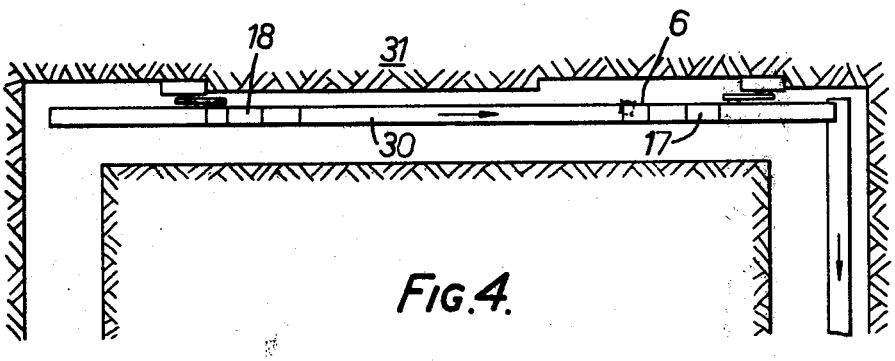

For a better understanding of the invention and to show how the same may be carried into effect, reference will now be made, by way of example, to the accompanying drawings, in which:

FIGS. 1*a* and 1*b* each show diagrammatically and in plan view a mining machine with a breaker unit at a different end, FIG. 2 is an end elevation of the breaker unit end of the upper mining maching in FIG. 1*a*, FIG. 3 is a vertical longitudinal sectional view through the breaker unit, and FIG. 4 illustrates the intended mode of use of the mining maching with breaker unit fitted.

Referring to FIGS. 1*a*, 1*b* and 2, a conveyor-mounted longwall mining machine comprises an underframe straddling the goaf and face side rails of the conveyor, denoted by reference 1 (FIG. 2), and being trapped by means of a goaf side tubular trapping 25. The underframe bears a haulage unit 2, for hauling the mining machine along the conveyor, an end cutter unit 50, and a main drive unit 3, for example incorporating an electric motor drive, which drives, via through shaft 20 passing through the haulage unit 2, a mineral working element in the form of a shearer drum 4 carried by a ranging arm 5 on the end cutter unit and which also drives the haulage unit itself by means of a haulage takeoff gear 21 on the through shaft 20. The units 2, 3, 50 together with the underframe constitute a main body assembly of the mining machine.

At the other end of the machine to the shearer drum, the machine incorporates breaking or crushing apparatus, including a breaker unit 6 mounted on an underframe 7 (FIGS. 2 and 3), preferably forming an integral extension of the main underframe of the mining machine so as to be rigidly secured to the main body assembly, the underframe being likewise trapped on the goaf side of the conveyor as shown in FIG. 2.

Referring now to FIG. 3, the breaker unit comprises a transmission unit 8, having an input drive shaft 9 driven directly by the main drive unit 3 through a coupling, suitable reduction gearing 10 driven by the input shaft, and a vertically disposed, output shaft 11 driven by the gearing 10 and having a connector 12 at its lower end coupled to a rotary breaking or crushing element in the form of a coaxial drum 13 bearing picks 14, the drum being located near the face side of the breaker unit and being supported at its lower end in the underframe 7.

Finally, reverting to FIGS. 1 and 2, the breaker unit incorporates a reaction plate 16 forming part of the underframe 7 and disposed opposite to, and spaced from the adjacent periphery of, the drum 13 at the goaf side of the breaking apparatus.

FIG. 4 illustrates diagrammatically the intended manner of use of the mining maching with breaker unit installed, the machine being designated by reference numeral 17, and a further mining machine 18 mounted on the same conveyor as the machine 17 but not incorporating a breaker unit. The mine face is denoted by reference numeral 31. The conveyor carries coal from the machine 18 along the face conveyor 30 in the direction indicated by the arrow. The coal is broken up or crushed to small pieces by the breaker unit 6 of the machine 17 by being impacted by the rotating pick-carrying drum against the reaction plate. In this way, the possibility of large lumps of coal becoming jammed under the main frame of the mining machine 17 is prevented.

It will be noted from FIG. 3 that the shaft 11 has a further connector 19 at its other end. The reason for this is that the transmission unit 8 is then constructed so as to be suitable for use in either left-hand machines, as in FIG. 1*a*, or to "right-hand" machines, as in FIG. 1*b*, thus obviating the need for different transmission units for the two kinds of machine. FIG. 3 shows the breaker unit in a left-hand mining machine. When incorporating the same unit in a right-hand machine, the transmission unit is turned over so that the connector 19 is lowermost and then the connector 19 is coupled to the drum 13, the connector 12 then being redundant. It should be noted that the input drive shaft 9 is then connected to an output coupling on the through shaft 20 of the haulage unit 2.

Advantages of the described mining maching are that the construction enables the electric motor drive of the mining machine to drive the breaker drum or, if separate drive motors were to be used for the shearer drum and for the machine haulage, either drive motor can be used to drive the breaker drum. Thus, the need for a separate drive motor for the rotary element of the breaking or crushing apparatus is obviated. Also, the overall construction as compared with the coupled-together breaking apparatus and mining machine disclosed in the aforesaid U.S. patent application Ser. No. 807,305 is simplified, in particular owing to merely extending the main underframe of the mining machine to provide the underframe of the breaker unit. Moreover, the breaker drum is supported in bearings at both ends whereas with the construction disclosed in U.S. patent application Ser. No. 807,305 the drum is mounted in bearings at one end only and this can impose a practical limitation on the length of breaker drum which can be used and increase wear on the bearings as compared with the present construction. Furthermore, the construction enables easier changing of the breaker drum and different sized drums can be selected in dependence on the height of the underframe of the mining machine.

In a modification, the breaker unit is pivotally mounted on the mining machine about a vertical axis in the manner disclosed in U.S. patent application Ser. No. 807,305 referred to above. Then the size of the opening between the rotary breaking element and the reaction plate can be adjusted to suit the intended size of the crushed coal lumps.

It is not essential that a plate be used against which the coal and rocks are impacted. Any other appropriate reaction means may be used instead. The reaction means may be provided with ribs, such as the longitudinally extending ribs 26 in FIG. 2, facing towards the pick-carrying drum so as to facilitate breaking of the coal and rocks.

We claim:

1. A longwall mining machine for use on a face conveyor, the mining machine comprising a main body assembly adapted for mounting on and movement along the conveyor, at least one mineral working element drivably carried by the main body assembly, and breaking or crushing apparatus rigidly secured to the main body assembly, the breaking apparatus comprising an underframe adapted for mounting on and movement along the conveyor, and a rotary breaking element drivably carried by the underframe, the latter being provided with reaction means against which material may be impacted and which is spaced laterally, with respect to the path of movement of the mining machine, from an adjacent periphery of the rotary element so as to define between the rotary element and the reaction means a material breaking gap whereby, in use of the mining machine, material on the conveyor passing between the rotary element and the reaction means is broken against the reaction means by the rotary element as the latter rotates.

2. A mining machine according to claim 1, wherein the reaction means is in the form of a reaction plate.

3. A mining machine according to claim 1, wherein the reaction means is provided with longitudinally extending ribs facing towards the adjacent periphery of the rotary element.

4. A mining machine according to claim 1, wherein the rotary element is mounted with its axis of rotation vertical, the upper end of the rotary element being the driven end and the lower end being supported by a bearing in the underframe of the breaking apparatus.

5. A mining machine according to claim 1, wherein the underframe of the breaking apparatus is an integral extension of the main underframe of the mining machine.

6. A mining machine according to claim 1, which incorporates a haulage unit and a single motor unit operative to drive the rotary element as well as the haulage unit and the mineral working element of the mining machine.

7. A mining machine according to claim 6, wherein the breaking apparatus includes a transmission unit comprising an input drive shaft coupled to be driven by said motor unit and an output driven shaft to which the rotary breaking element is coaxially and directly coupled.

8. A mining machine according to claim 7, wherein the output shaft of the transmission unit is coupled to the rotary element by a connector at one end of the shaft, and wherein a further connector is provided on the other end of the shaft so that the transmission unit could have been installed at a corresponding position nearer the other end of the machine by turning the transmission unit over so that the second-mentioned connector is lowermost, and then connecting the rotary element to this latter connector.

* * * * *